US010232634B2

(12) United States Patent
Ogasahara

(10) Patent No.: US 10,232,634 B2
(45) Date of Patent: Mar. 19, 2019

(54) INKJET RECORDING APPARATUS

(71) Applicant: KYOCERA Document Solutions Inc., Osaka (JP)

(72) Inventor: Okito Ogasahara, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/872,729

(22) Filed: Jan. 16, 2018

(65) Prior Publication Data

US 2018/0207945 A1 Jul. 26, 2018

(30) Foreign Application Priority Data

Jan. 20, 2017 (JP) ..... 2017-008186

(51) Int. Cl.

| | |
|---|---|
| ***B41J 2/195*** | (2006.01) |
| ***B41J 2/36*** | (2006.01) |
| ***B41J 2/045*** | (2006.01) |
| ***B41J 2/155*** | (2006.01) |
| ***B41J 29/38*** | (2006.01) |
| ***B41J 11/00*** | (2006.01) |
| ***B41J 2/21*** | (2006.01) |
| *B41J 2/14* | (2006.01) |

(52) U.S. Cl.

CPC ..... *B41J 2/195* (2013.01); *B41J 2/155* (2013.01); *B41J 2/2135* (2013.01); *B41J 2/2146* (2013.01); *B41J 2/362* (2013.01); *B41J 11/007* (2013.01); *B41J 29/38* (2013.01); *B41J 2/14* (2013.01)

(58) Field of Classification Search

CPC . B41J 2/04558; B41J 2/14; B41J 2/155; B41J 2/195; B41J 2/2139; B41J 2/362; B41J 3/543; H04N 1/486

See application file for complete search history.

(56) References Cited

U.S. PATENT DOCUMENTS

| | | | | |
|---|---|---|---|---|
| 6,747,766 | B1 * | 6/2004 | Kamisuwa | H04N 1/486 358/1.9 |
| 2004/0179055 | A1 * | 9/2004 | Kawauchi | B41J 2/04505 347/19 |
| 2012/0154477 | A1 * | 6/2012 | Yamazaki | B41J 2/2139 347/19 |
| 2016/0236466 | A1 * | 8/2016 | Takahashi | B41J 2/04515 |
| 2016/0288527 | A1 * | 10/2016 | Hasegawa | B41J 2/2103 |

FOREIGN PATENT DOCUMENTS

| | | |
|---|---|---|
| JP | 2015-123655 A | 7/2015 |

* cited by examiner

*Primary Examiner* — Anh T Vo
(74) *Attorney, Agent, or Firm* — Stein IP, LLC

(57) ABSTRACT

In an inkjet recording apparatus, a control section forms a test chart in which a plurality of lines, each extending along the recording-medium width direction, are drawn arranged along the recording-medium conveyance direction by making the ink ejection nozzles eject ink, while gradually changing either ink ejection timing with respect to each of the ink ejection nozzles or a recording-medium conveyance speed. Furthermore, the control section checks for, and corrects, pixel deviation in the recording-medium conveyance direction based on the test chart.

3 Claims, 5 Drawing Sheets

INKJET RECORDING APPARATUS

INCORPORATION BY REFERENCE

This application is based upon and claims the benefit of priority from the corresponding Japanese Patent Application No. 2017-008186 filed on Jan. 20, 2017, the entire contents of which are incorporated herein by reference.

BACKGROUND

The present disclosure relates to an inkjet recording apparatus.

As image forming apparatuses, such as copiers and printers, inkjet recording apparatuses have been widely spread in recent years. Inkjet recording apparatuses can be classified into those of a serial type, in which recording is performed while a recording head is scanning across a recording medium such as a sheet, and those of a line-head type, in which recording is performed by a recording head fixed to the apparatus main body.

In order to continue high-quality recording with an inkjet recording apparatus, it is necessary to appropriately monitor deviation of pixels of ink ejected from an ink ejection nozzle provided in a recording head. To meet such a demand, in the field of inkjet recording apparatuses, a conventional technique is known in which pixel deviation is monitored by recording on a sheet a test chart constituted by a predetermined pattern, and checking for positional deviation of the pattern in the test chart.

A printing apparatus according to the conventional technique has printing heads disposed in a manner staggered in a continuous-sheet conveyance direction, and records a predetermined measurement pattern (a test chart) on a continuous sheet. In the measurement pattern, a line is formed to extend along a continuous-sheet width direction which crosses the continuous-sheet conveyance direction. The printing apparatus detects, by means of a test section, an amount of stepwise deviation in the measurement pattern in the continuous-sheet conveyance direction, and performs printing position correcting processing so as to prevent the stepwise deviation from increasing.

SUMMARY

According to an aspect of the present disclosure, an inkjet recording apparatus includes a conveyance section, a recording section, and a control section. The conveyance section conveys a recording medium. The recording section is disposed to face a recording medium conveyed by the conveyance section, has a recording head in which a plurality of ink ejection nozzles are arranged along a recording-medium width direction which crosses a recording-medium conveyance direction, and ejects ink onto the recording medium. The control section controls operations of the conveyance section and the recording section. Here, the control section forms a test chart in which a plurality of lines, each extending along the recording-medium width direction, are drawn arranged along the recording-medium conveyance direction by making the ink ejection nozzles eject ink, while gradually changing either ink ejection timing with respect to each of the ink ejection nozzles or a recording-medium conveyance speed. Moreover, the control section checks for, and corrects, pixel deviation in the recording-medium conveyance direction based on the test chart.

DETAILED DESCRIPTION

Embodiments of the present disclosure will be described below with reference to the accompanying drawings. The present disclosure is not limited to what is specifically mentioned below.

Figure 1:
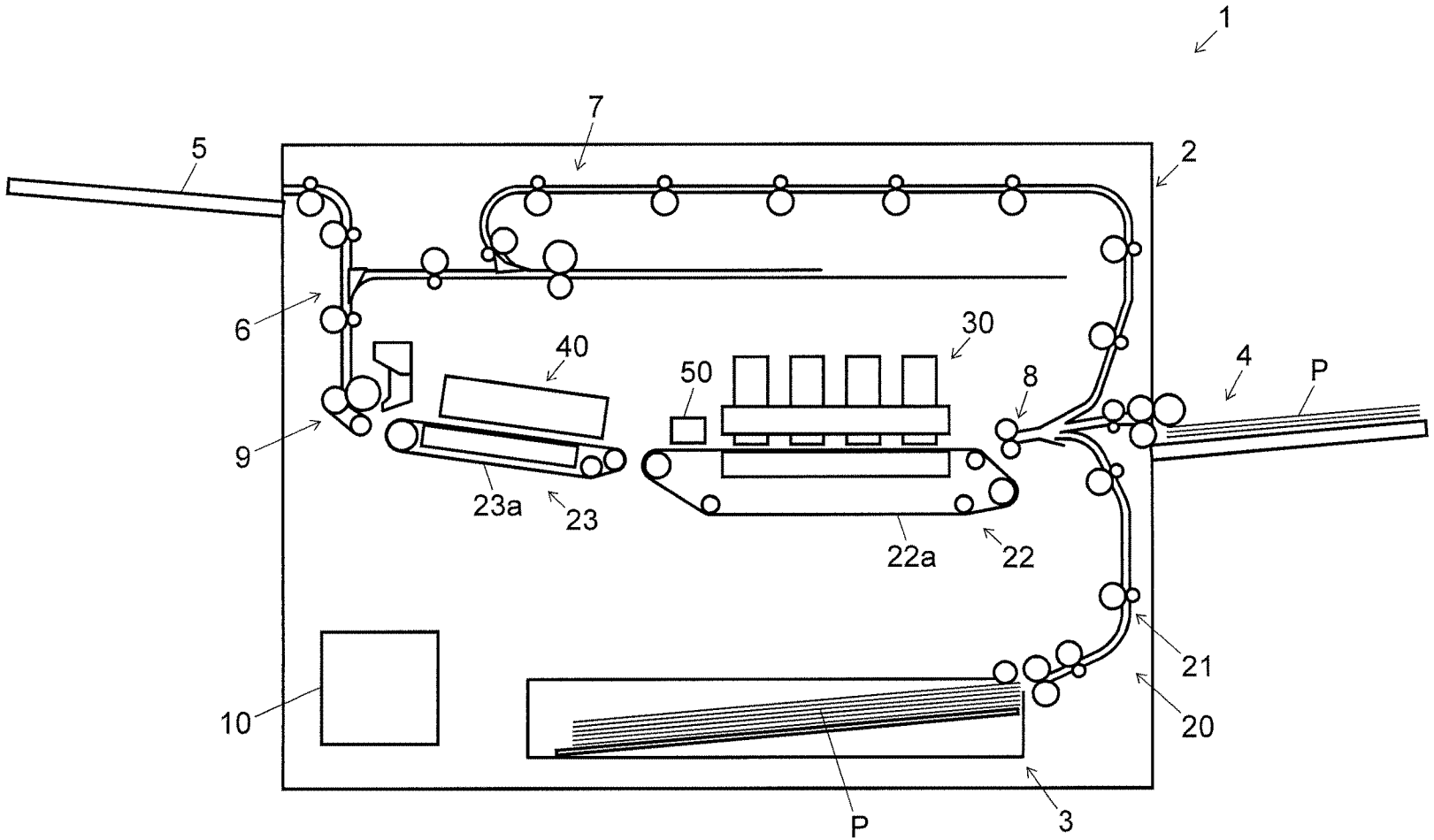
FIG. 1 is a front vertical sectional view of an inkjet recording apparatus according to an embodiment of the present disclosure.
Figure 2:
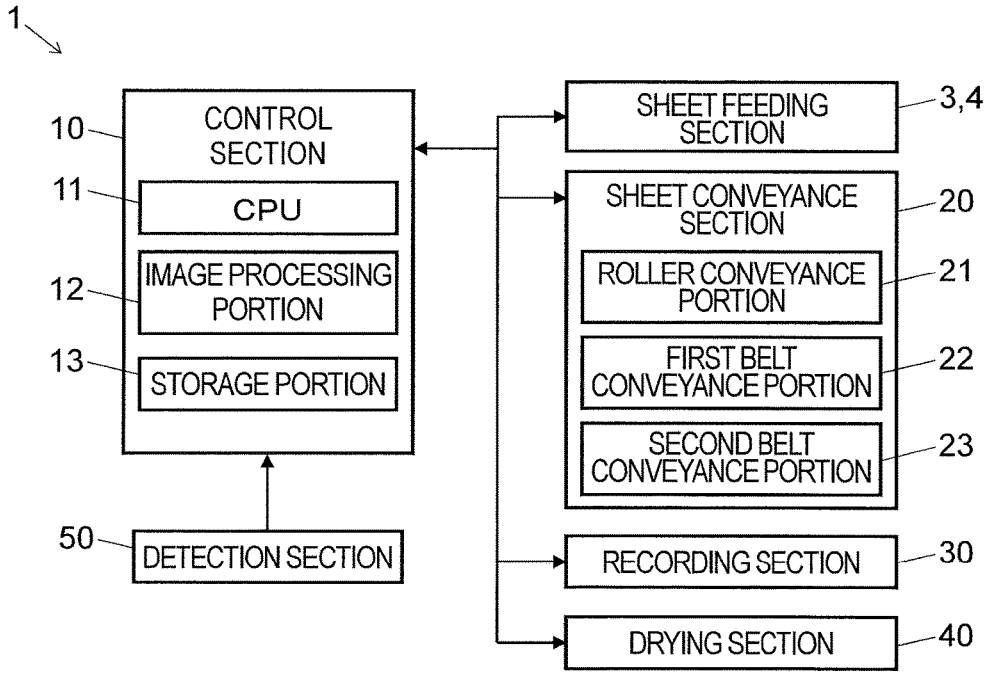
FIG. 2 is a block diagram illustrating a configuration of the inkjet recording apparatus according to the embodiment of the present disclosure.

First, a description will be given of an inkjet recording apparatus according to an embodiment of the present disclosure, with reference to FIG. 1 and FIG. 2. FIG. 1 is an example of front vertical sectional view illustrating a schematic configuration of the inkjet recording apparatus. FIG. 2 is a block diagram illustrating a configuration of the inkjet recording apparatus.

The inkjet recording apparatus 1 illustrated in FIG. 1 and FIG. 2, which employs an inkjet recording method, is what is called a printer. The inkjet recording apparatus 1 includes a sheet feeding cassette 3 and a manual sheet feeding tray 4 as a sheet feeding section for feeding a sheet P as a recording medium.

The sheet feeding cassette 3 is disposed at a lower portion of an inside of a main body 2 of the inkjet recording apparatus 1. The manual sheet feeding tray 4 is disposed on an outer right side surface of the main body 2. The sheet feeding cassette 3 and the manual sheet feeding tray 4 each accommodate a plurality of sheets P, and feed them to a sheet conveyance section 20 separately one by one during printing.

The sheet conveyance section 20 is disposed on a downstream side of the sheet feeding cassette 3 and the manual sheet feeding tray 4 with respect to a sheet conveyance direction. The sheet conveyance section 20 includes a roller conveyance portion 21, a first belt conveyance portion 22, and a second belt conveyance portion 23. The roller conveyance portion 21 conveys a sheet P by nipping it in a nip portion of a pair of rollers which contact each other by being pressed against each other. The first belt conveyance portion 22 and the second belt conveyance portion 23 adsorb, hold, and convey a sheet P on upper surfaces thereof, which are respectively a sheet conveyance surface of a first conveyance belt 22*a* and a sheet conveyance surface of a second conveyance belt 23*a*. The sheet conveyance section 20 conveys a sheet P fed out from the sheet feeding cassette 3 or the manual sheet feeding tray 4 to a recording section 30 and a drying section 40, and further discharges the sheet P into a sheet discharge tray 5 after recording and drying operations are performed with respect to the sheet P.

The sheet conveyance section 20 includes a switching portion 6 on an upstream side of the sheet discharge tray 5 with respect to the sheet conveyance direction. In a case where two-side printing is to be performed, a sheet P is conveyed from the switching portion 6 to a sheet turning-over portion 7, which is disposed above the recording section 30 and the drying section 40. Through the sheet turning-over portion 7, the conveyance direction of the sheet P is switched to turn it upside down, and then the sheet P is conveyed through an upper portion of the main body 2, and then conveyed back to an upstream side of the recording section 30.

The sheet conveyance section 20 includes a registration roller pair 8, which is disposed on the upstream side of the recording section 30 with respect to the sheet conveyance direction. The registration roller pair 8 corrects oblique feeding of the paper P and, with timing coordinated with an ink ejecting operation executed by the recording section 30, feeds out the sheet P toward the first belt conveyance portion 22.

The recording section 30 is disposed over the first belt conveyance portion 22 so as to face a sheet P conveyed by the first belt conveyance portion 22. The recording section 30 includes recording heads 32K, 32Y, 32M, and 32C, which are line-type inkjet heads corresponding to four colors of black, yellow, magenta, and cyan, respectively (see FIG. 3). The recording section 30 ejects ink onto a sheet P conveyed by being adsorbed and held on the first conveyance belt 22*a*, sequentially from the recording heads 32K, 32Y, 32M, and 32C, to thereby record a full color image in which black, yellow, magenta and cyan inks are superimposed. Further, with the inkjet recording apparatus 1, it is also possible to record a monochrome image.

The drying section 40 is arranged on a downstream side of the recording section 30 with respect to the sheet conveyance direction, and the second belt conveyance portion 23 is disposed under the drying section 40. After having an ink image recorded thereon at the recording section 30, a sheet P is conveyed under the drying section 40 by being adsorbed and held on the second conveyance belt 23*a*, during which ink on the sheet P is dried by the drying section 40.

At a position on a downstream side of the drying section 40 with respect to the sheet conveyance direction, near a left side surface of the main body 2, there is disposed a decurler portion 9. The sheet P, having the ink thereon dried at the drying section 40, is sent to the decurler portion 9, where curling caused in the sheet P is corrected.

The inkjet recording apparatus 1 further includes a control section 10. The control section 10 includes a CPU 11, an image processing portion 12, a storage portion 13, and other unillustrated electronic components and circuits. The CPU 11 controls operations of various components of the inkjet recording apparatus 1, such as the sheet conveyance section 20 and the recording section 30, based on control programs and data stored in the storage portion 13, and performs recording processing with respect to a sheet P. The image processing portion 12 performs, with respect to image data received from an external computer, image processing for realizing suitable recording. The storage portion 13 comprises, for example, a combination of a non-volatile storage device, such as a program ROM and a data ROM, and a volatile storage device, such as a RAM, of which none is illustrated.

Figure 3:
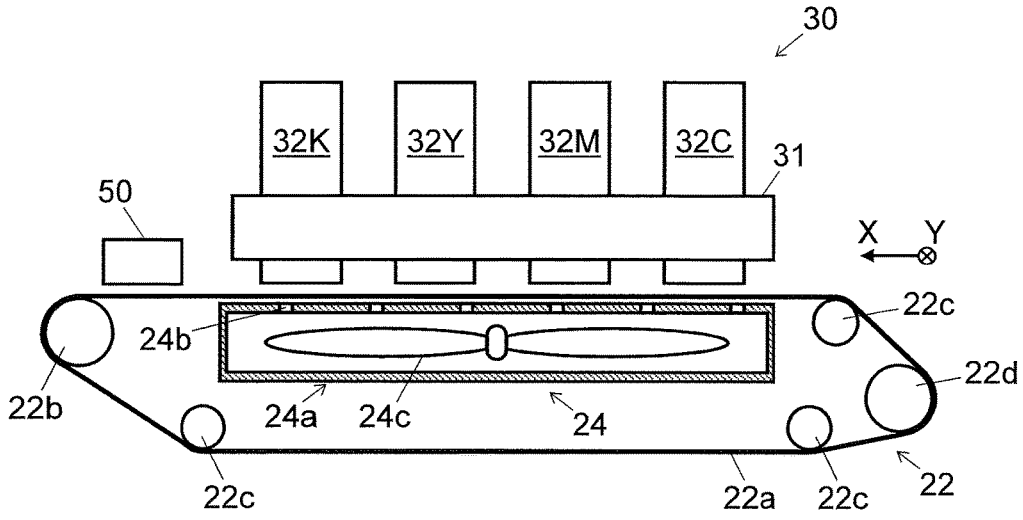
FIG. 3 is a front view of a recording section and the vicinity thereof in the inkjet recording apparatus according to the embodiment of the present disclosure.
Figure 4:
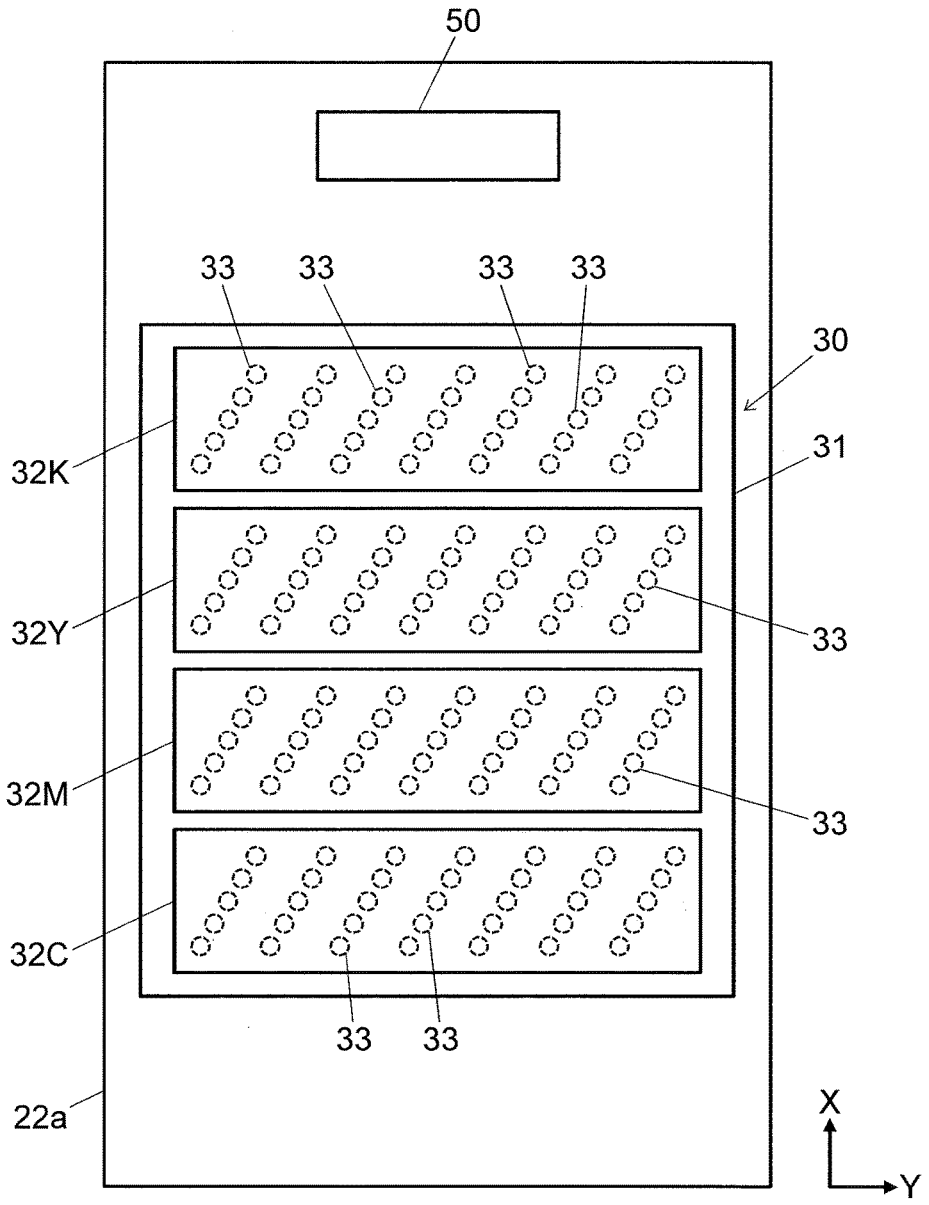
FIG. 4 is a top view of the recording section and the vicinity thereof in the inkjet recording apparatus according to the embodiment of the present disclosure.

Next, detailed configurations of the recording section 30 and the vicinity thereof will be described by using FIG. 3 and FIG. 4. FIG. 3 and FIG. 4 are a front view and a top view, respectively, of the recording section 30 and the vicinity thereof. In FIG. 3 and FIG. 4, arrow X indicates the sheet conveyance direction, in which sheets P are conveyed, and arrow Y indicates a sheet width direction of sheets P, which is perpendicular to the sheet conveyance direction.

The first belt conveyance portion 22 includes, in addition to the first conveyance belt 22*a*, a drive roller 22*b*, a driven roller 22*c*, and a tension roller 22*d*. The first conveyance belt 22*a* is an endless belt wound around the drive roller 22*b*, the driven roller 22*c*, and the tension roller 22*d*. The first conveyance belt 22*a* is caused by the drive roller 22*b* to rotate in a counterclockwise direction in FIG. 3. A sheet P fed out from the registration roller pair 8 is conveyed from right to left in FIG. 3 in a state of being adsorbed and held on an upper surface of the first conveyance belt 22*a*, and passes under the recording section 30.

Inside the first conveyance belt 22*a*, at a position facing a back side of the sheet conveyance surface of the first conveyance belt 22*a*, a sheet suction portion 24 is disposed. The sheet suction portion 24 includes a large number of holes 24*b*, which are formed in a top surface of a housing 24*a* thereof to penetrate the top surface to allow communication between inside and outside of the housing 24*a*, and a suction fan 24*c*, which is disposed inside the housing 24*a*. The sheet suction portion 24 is capable of sucking air downward through the top surface of the housing 24*a* by driving the suction fan 24*c*. Further, the first conveyance belt 22*a* also includes a large number of holes (not shown) for air suction, which penetrate the first conveyance belt 22*a* in its thickness direction. With this configuration, the first belt conveyance portion 22 conveys the sheet P while adsorbing and holding a sheet P on the top surface, that is to say, the sheet conveyance surface, of the first conveyance belt 22*a*.

The recording section 30 includes a head housing 31, in addition to the recording heads 32K, 32Y, 32M, and 32C. The recording heads 32K, 32Y, 32M, and 32C are held by the head housing 31. The recording heads 32K, 32Y, 32M, and 32C each have a shape extending along the sheet width direction, and the four recording heads are arranged in one line along the sheet conveyance direction. Note that the recording heads 32 have the same basic structure, and thus the color identification signs will sometimes be omitted.

The recording heads 32 are supported over the first conveyance belt 22*a*, at a predetermined distance (1 mm, for example) from the sheet conveyance surface of the first conveyance belt 22*a*. The recording heads 32 each have a recording region, which is as wide as or wider than the width of the sheet P conveyed by the first conveyance belt 22*a*, with respect to the sheet width direction.

As shown in FIG. 4, each of the recording heads 32 includes a plurality of ink ejection nozzles 33 provided in an ink ejection portion thereof, which is a bottom portion thereof. The plurality of ink ejection nozzles 33 are arranged along the sheet width direction such that they are able to eject ink over the whole recording region. The ink ejection nozzles 33 are arranged, as shown in FIG. 4, such that a plurality of ink-ejection-nozzle-33 groups, each composed of a predetermined number of ink ejection nozzles 33 which are arranged in a line diagonal to both the sheet conveyance direction and the sheet width direction, are arranged in the sheet width direction. The ink ejection nozzles 33 of the respective colors sequentially receive supply of ink from unillustrated ink tanks.

On a downstream side of each of the recording heads 32 with respect to the sheet conveyance direction, a detection section 50 is disposed. The detection section 50 is disposed above the first belt conveyance portion 22 to face a sheet P conveyed by the first belt conveyance portion 22. The detection section 50 is supported over the first conveyance belt 22*a*, at a predetermined distance from the sheet conveyance surface of the first conveyance belt 22*a*. The detection section 50 is disposed, for example, at a center portion of each of the recording heads 32 in the sheet width direction.

The detection section 50 is constituted by an image density sensor, for example, and includes a light source and a light receiving element, neither of which is illustrated. The light source comprises a light emitting diode (LED), for example, and the light receiving element comprises a photo diode, for example. The light source emits light toward a sheet P, which reflects the light, and the light receiving element receives the light reflected from the sheet P, whereby the detection section 50 detects the density of ink which has been ejected onto the sheet P by the recording section 30.

The inkjet recording apparatus 1 configured as described above has a pixel deviation checking function for finding pixel deviation of ink ejected from the ink ejection nozzles 33.

Figure 5:
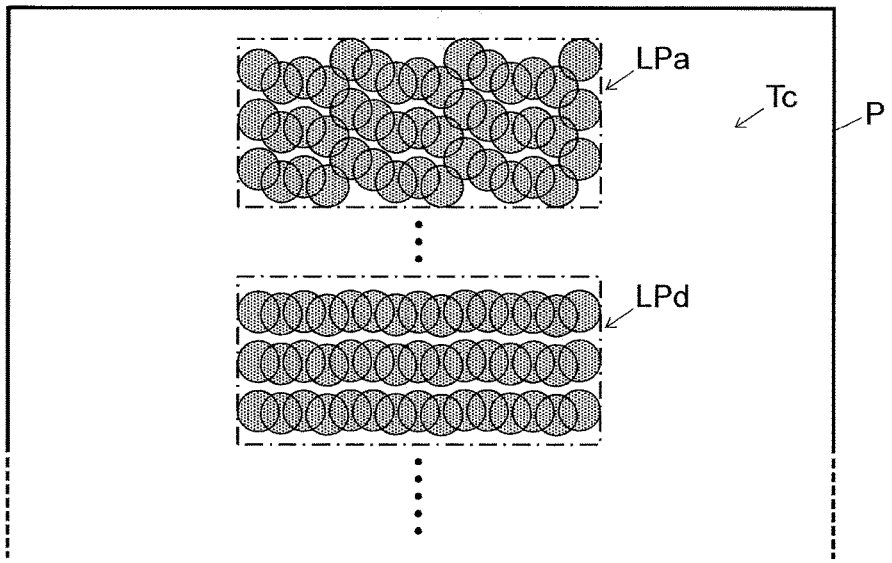
FIG. 5 is a top view of a test chart used for a pixel deviation checking function of the inkjet recording apparatus according to the embodiment of the present disclosure.
Figure 6:
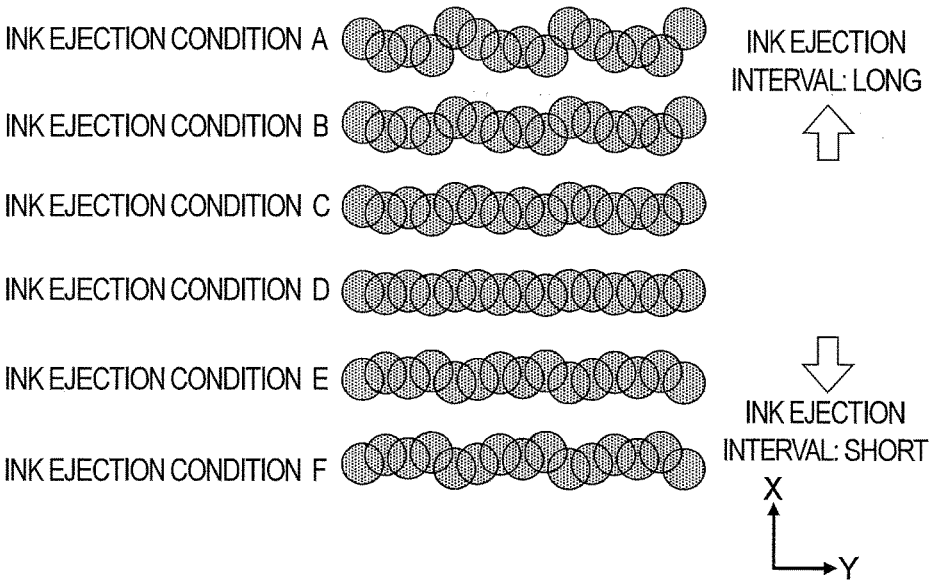
FIG. 6 is a diagram for illustrating an ink ejection condition used for the pixel deviation checking function of the inkjet recording apparatus according to the embodiment of the present disclosure.
Figure 7:
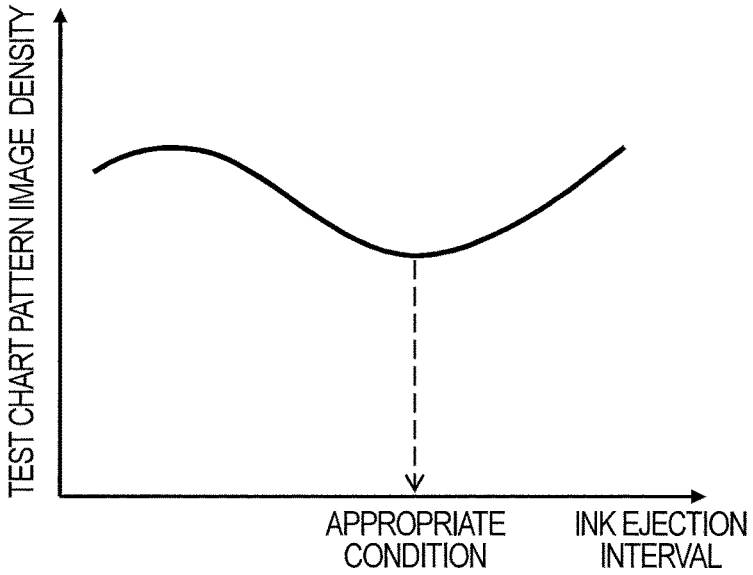
FIG. 7 is a graph illustrating a relationship between ink ejection condition and sensor output (ink density) of the test chart in the inkjet recording apparatus according to the embodiment of the present disclosure.

Next, a description will be given of the pixel deviation checking function of the inkjet recording apparatus 1 with reference to FIG. 5 to FIG. 7. FIG. 5 is a top view of a test chart used for the pixel deviation checking function of the inkjet recording apparatus 1. FIG. 6 is a diagram for illustrating an ink ejection condition used for the pixel deviation checking function of the inkjet recording apparatus 1. FIG. 7 is a graph illustrating a relationship between the ink ejection condition and the sensor output (ink density) of the test chart.

In the inkjet recording apparatus 1, in the pixel deviation checking function, the control section 10 records on a sheet P a test chart Tc shown in FIG. 5, which is constituted by a predetermined pattern image.

The test chart Tc includes a plurality of pattern images LPa and LPd, for example. In the pattern images LPa and LPd, a plurality of (for example, three) lines each extending in the sheet width direction are drawn with ink ejected from the plurality of ink ejection nozzles 33 arranged along the sheet width direction such that the plurality of lines are arranged along the sheet conveyance direction.

In forming the pattern images LPa and LPd, the control section 10 makes the ink ejection nozzles 33 eject ink while gradually changing either ink ejecting timing for each of the plurality of ink ejection nozzles 33 or sheet conveyance speed at which a sheet P is conveyed. As shown in FIG. 6, for example, the control section 10 draws lines extending in the sheet width direction under seven different conditions, namely, ink ejection condition A to ink ejection condition F, between which either the ink ejection timing or the sheet conveyance speed is gradually changed.

When the ink ejection timing or the sheet conveyance speed is gradually changed, the change causes a change in ink ejection interval. Under ink ejection condition A, the ink ejection interval is the longest, and the ink ejection interval is made gradually shorter in alphabetical sequence such that the ink ejection interval is shorter under ink ejection condition C than under ink ejection condition B, and the ink ejection interval is the shortest under ink ejection condition F. Note that FIG. 5 shows, as examples, the pattern image LPa and the pattern image LPd, which have been drawn under ink ejection condition A and ink ejection condition D, respectively.

The detection section 50, with respect to the test chart Tc on a sheet P conveyed by the first conveyance belt 22*a*, at a predetermined timing, detects ink density of each of the plurality of pattern images drawn in the test chart Tc. A result of the detection is shown in FIG. 7, as a graph indicating a relationship between the ink ejection condition and the sensor output (ink density) of the test chart Tc. In FIG. 7, the horizontal axis represents the ink ejection interval (ink ejection condition), and the vertical axis represents the ink density of a pattern image in the test chart Tc.

Here, in the case of the pattern image LPd shown in FIG. 5 and drawn under ink ejection condition D, where the lines extending in the sheet width direction are substantially straight lines, the ink density of the pattern image LPd as a whole becomes relatively low. On the other hand, in the case of the pattern image LPa shown in FIG. 5 and drawn under ink ejection condition A, where the lines extending in the sheet width direction are curved, the ink density of the pattern image LPa as a whole becomes relatively high.

From FIG. 7, it is preferable to select, as an appropriate condition, an ink ejection interval with which the ink density of the pattern image becomes the lowest. Thereby, the lines extending in the sheet width direction are substantially straight lines like in the pattern image LPd drawn under the ink ejection condition D. In the above manner, the inkjet recording apparatus 1 checks for, and corrects, pixel deviation in the sheet conveyance direction based on the test chart Tc.

Note that the above-configured test chart Tc makes it possible to visually check for pixel deviation. What is visually checked is, for example, whether ink non-ejected areas between the lines in the pattern image extend straight in the sheet width direction. This makes it possible, with a simple configuration, to check for pixel deviation in the sheet conveyance direction in the test chart Tc, and continue high-quality recording.

Furthermore, with the use of the detection section 50 to detect the ink density of the test chart Tc to thereby check for pixel deviation in the sheet conveyance direction, it becomes possible to check for pixel deviation with even higher accuracy.

Moreover, since the detection section 50 is an image density sensor having a light source and a light receiving element, the inkjet recording apparatus 1 does not need a highly accurate sensor. This makes it possible to reduce increase in cost of the inkjet recording apparatus 1.

Furthermore, in each of the recording heads 32, the ink ejection nozzles 33 adjacent to each other in the sheet width direction are arranged shifted in the sheet conveyance direction. This makes it possible to increase the resolution of the inkjet recording apparatus 1. Moreover, even in the case where the ink ejection nozzles 33 are arranged shifted in the sheet conveyance direction as described above, the test chart Tc configured as described above makes it possible to visually check for pixel deviation.

It should be understood that the embodiments of the present disclosure described above are in no way meant to limit its scope; the present disclosure can be implemented with any modifications made without departing from its spirit.

For example, in the above embodiments, the ink ejection nozzles 33 are arranged, as shown in FIG. 4, such that a plurality of ink-ejection-nozzle-33 groups, each composed of a predetermined number of ink ejection nozzles 33 which are arranged in a line diagonal to both the sheet conveyance direction and the sheet width direction, are arranged in the sheet width direction, but this arrangement is not meant as a limitation. In each of the recording heads 32, the ink ejection nozzles 33 may be disposed in a staggered arrangement in the sheet width direction. Or, for example, in each of the recording heads 32, the ink ejection nozzles 33 may be arranged in one straight line in the sheet width direction. Or, each of the recording heads 32 may be divided into a plurality of parts with respect to the sheet width direction, and the parts in each of the recording heads 32 may be disposed in a staggered arrangement in the sheet width direction.

As the detection section 50, a contact image sensor or a sensor using a charge coupled device (CCD), for example, may be used instead of an image density sensor.

What is claimed is:

1. An inkjet recording apparatus comprising:

a conveyance section which conveys a recording medium;

a recording section which is disposed to face the recording medium conveyed by the conveyance section, which has a recording head in which a plurality of ink ejection nozzles are arranged along a recording-medium width direction which crosses a recording-medium conveyance direction, and which ejects ink onto the recording medium;

a control section which controls operations of the conveyance section and the recording section and a detection section for detecting ink density of the recording medium, the detection section being disposed to face the recording medium conveyed by the conveyance section, wherein the control section forms a test chart in which a plurality of lines, each extending along the recording-medium width direction, are drawn arranged along the recording-medium conveyance direction by making the ink ejection nozzles eject ink, while gradually changing either ink ejection timing with respect to each of the ink ejection nozzles or a recording-medium conveyance speed, and detects ink density of the test chart by using the detection section, and selects, as an appropriate condition, an ink ejection interval with which the ink density of the pattern image becomes the lowest, and thereby checks for, and corrects, pixel deviation in the recording-medium conveyance direction.

2. The inkjet recording apparatus according to claim 1, wherein the detection section is an image density sensor having a light source and a light receiving element.

3. The inkjet recording apparatus according to claim 1, wherein, in the recording head, the ink ejection nozzles adjacent to each other in the recording-medium width direction are arranged shifted in the sheet conveyance direction.

* * * * *